US005754916A

United States Patent [19]

Kitayama et al.

[11] Patent Number: 5,754,916

[45] Date of Patent: May 19, 1998

[54] IMAGE FORMING APPARATUS

[75] Inventors: Kunihiko Kitayama, Kawasaki; Motoaki Tahara, Yokohama, both of Japan

[73] Assignee: Canon Kabushiki Kaisha, Japan

[21] Appl. No.: 679,563

[22] Filed: Jul. 15, 1996

[30] Foreign Application Priority Data

Jul. 18, 1995 [JP] Japan ..... 7-181691

[51] Int. Cl.[6] ..... G03G 15/08

[52] U.S. Cl. ..... 399/27; 399/29; 399/260; 222/DIG. 1

[58] Field of Search ..... 399/27, 29, 30, 399/58, 61, 62, 258, 260; 222/DIG. 1

[56] References Cited

U.S. PATENT DOCUMENTS

| | | | |
|---|---|---|---|
| 4,589,762 | 5/1986 | Schamphelaere et al. | 399/58 |
| 4,626,096 | 12/1986 | Ohtsuka et al. | 399/27 |
| 4,707,748 | 11/1987 | Ohtsuka et al. | 358/298 |
| 4,745,440 | 5/1988 | Kono et al. | 399/27 |
| 4,777,512 | 10/1988 | Takahashi et al. | 399/30 |
| 5,095,331 | 3/1992 | Takano | 399/63 |
| 5,160,966 | 11/1992 | Shiina et al. | 399/27 |
| 5,182,600 | 1/1993 | Hasegawa et al. | 399/74 |
| 5,204,698 | 4/1993 | LeSueur et al. | 347/140 |
| 5,214,476 | 5/1993 | Nomura et al. | 399/30 |
| 5,227,847 | 7/1993 | Motohashi et al. | 399/27 |
| 5,331,377 | 7/1994 | Matsuura et al. | 399/27 |
| 5,374,977 | 12/1994 | Shiina et al. | 399/27 |
| 5,581,326 | 12/1996 | Ogata et al. | 399/30 |

*Primary Examiner*—Matthew S. Smith

*Attorney, Agent, or Firm*—Fitzpatirick, Cella, Harper & Scinto

[57] ABSTRACT

An image forming apparatus includes an image carrying member for carrying an image, a developing unit for developing an electrostatic image on the image carrying member, and a toner storage unit for storing the toners and replenishing the toners to the developing unit. In the image forming apparatus, a residual quantity of the toners within the toner storage unit is detected, and a quantity of toners substantially replenished to the developing unit from the toner storage unit is integrated. When a deficiency of the toner residual quantity is detected during a consecutive image forming operation, there is stopped and inhibited the image forming operation when an integrated value of the replenishing toner quantity reaches a predetermined value since the deficiency of the toner residual quantity was detected.

12 Claims, 5 Drawing Sheets

IMAGE FORMING APPARATUS

BACKGROUND OF THE INVENTION

1. Field of the Invention

The present invention relates to an image forming apparatus such as a copying machine, a printer and the like of an electronic photographing system and a electrostatic recording system for developing an electrostatic image on an image carrier with toners.

2. Related Background Art

In general, an image forming apparatus in an electronic photographing system and an electrostatic recording system includes a toner hopper for storing toners by way of a part of a developing device. This toner hopper is typically constructed of a feeding member such a screw for feeding the toners to a developing unit, an agitation unit for disintegrating the toners within the container, and a residual quantity detecting sensor for detecting that a residual quantity of the toners within the container becomes small. When the residual quantity detecting sensor works upon a descent of a powder surface level of the toners due to a consumption of the toners, "No Toner" is indicated, whereby a next copy is not accepted.

Then, the user replenishes the toners to the hopper from a toner bottle or the like, thereby making it possible for the copy to resume. If the residual quantity detecting sensor works during continuous copying, there are two methods of indicating "No Toner" by temporarily interrupting the copying operation and of indicating "No Toner" after finishing the continuous copying operation. The latter one of those methods is, as a matter of course, desirable for the operator. An execution of this may involve securing a predetermined quantity of toners that can be replenished after the detection in a lower portion of the residual quantity detecting sensor. This predetermined quantity is a value obtained by multiplying an estimated maximum toner applied quantity (a maximum toner quantity consumed per one sheet) by a maximum determined sheet number. In, for instance, a full-color copying machine, the maximum toner applied quantity is calculated approximately 1 g when a sheet of A3 size is copied with a set-solid image (black all over image area, etc.), and calculated approximately 100 g when the maximum determined sheet number is set to 99 sheets.

Accordingly, if the toners of about 100 g are stored in the lower portion of the residual quantity detecting sensor, the copy interruption during the copying operation can be avoided. If the maximum determined sheet number is set to, e.g., 999 sheets by connecting a sorter to this copying machine and increasing a discharged sheet stack capacity, however, the toners of approximately 1000 g are required to be stored. When converting this quantity into volume, it becomes about 2500 cc. Herein, supposing that volume of the hopper above the residual quantity detecting sensor is set to 2500 cc, the hopper volume is as large as 5000 cc=5 l (20 for four colors) for every color. This might bring about large-sizing of the apparatus.

For avoiding this drawback, if the residual quantity detecting sensor works during the continuous copying, it is a general practice that counting of a copy sheet number is started upon the detection, and the copying operation is interrupted just when a predetermined number of sheets are reached.

As explained above, a predetermined sheet number x (sheets) is set such as $x = z/y$, wherein z is the toner quantity (g) stored under the residual quantity detecting sensor, and y is the consumption quantity (g/sheet). The consumption quantity y takes a highest estimated value, and hence there arises a drawback due to such a situation that the copy is interrupted depending on the sheet number, even in a case where there is no necessity for the interruption thereof because of a considerable remaining of the toners upon copying a image requiring a small amount of consumption of toners.

For example, an image ratio is 10%, and the sheet is A3 size. In this case, the toner applied quantity is approximately 0.1 g/sheet. If the quantity of the toner below the sensor is assumed to be 100 g, 1000 sheets can be copied, so if the maximum determined sheet number is 999 sheets, the possibility of interruption of copying is 0% in itself. In this case, however, since the quantity of the toner below the sensor is 100 g and the predetermined sheet number is set to 100 sheets, if a non-copied sheet number exceeds 100 sheets just when the residual quantity detecting sensor works, the copy is interrupted in spite of the fact that sufficient toners of about 90 g are left. Actually, there are many originals having a comparatively low image ratio, for example, if the ratio is 10%, a copy-possible sheet number (in terms of the toner quantity) after the detection is 10 times as large as the predetermined sheet number. Similarly, if the ratio is 20%, the copy-possible sheet number is 5 times. This method brings about such a result as to increase the probability of interruption at a considerably high ratio.

SUMMARY OF THE INVENTION

It is a primary object of the present invention to provide an image forming apparatus adapted to reduce a probability of a copy interruption during a continuous image forming operation.

It is another object of the present invention to provide an image forming apparatus capable of forming images on a great number of sheets by use of a hopper having a relatively small capacity.

To accomplish the objects given above, according to one aspect of the invention, an image forming apparatus is provided with an image carrying member for carrying an image, a developing unit for developing an electrostatic image on the image carrying member, a toner storage unit for storing the toners and replenishing the toners to the developing unit, a residual quantity detecting unit for detecting a residual quantity of the toners within the toner storage unit, an integrating unit for integrating a quantity of toners substantially replenished to the developing unit from the toner storage unit, and an inhibiting unit for stopping and inhibiting an image forming operation when an integrated value of the replenishing toner quantity reaches a predetermined value after the residual quantity detecting unit has detected lack of the toner residual quantity if the residual quantity detecting unit detects the lack of the toner residual quantity during continuous image forming operation.

Other objects of the present invention will become apparent during the following discussion.

DESCRIPTION OF THE PREFERRED EMBODIMENTS

Embodiments of the present invention will hereinafter be described with reference to the accompanying drawings.

Figure 4:
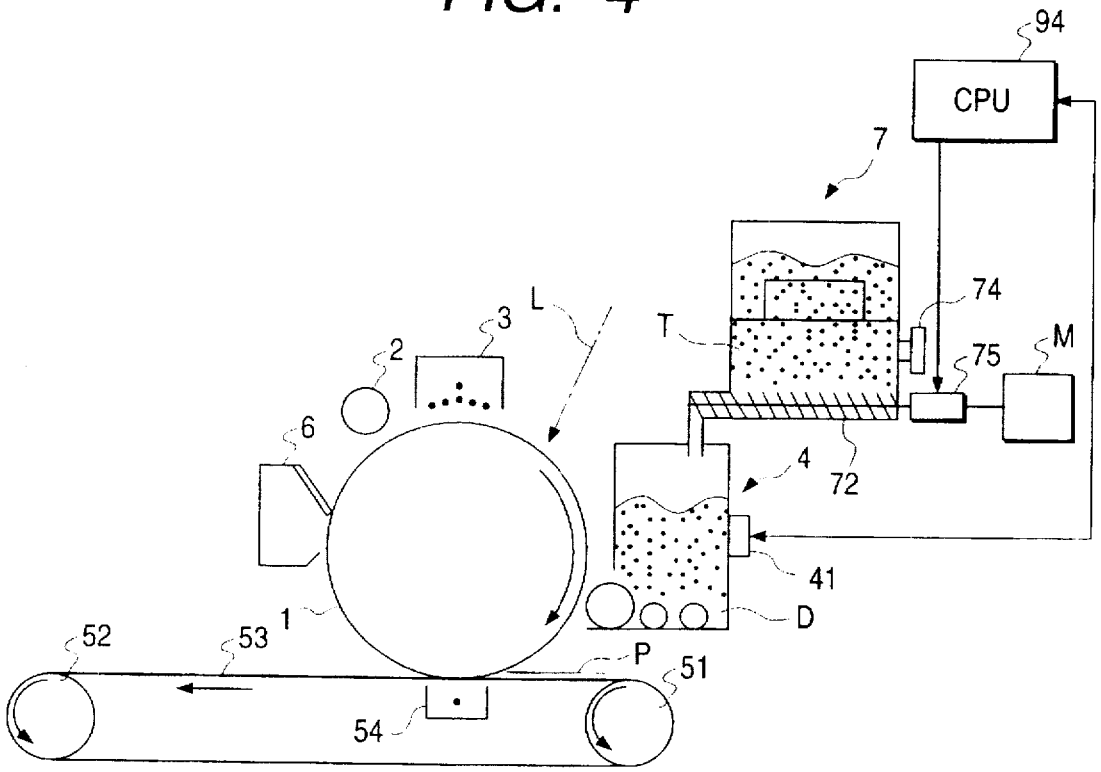
FIG. 4 is a view illustrating an outline of an image forming apparatus in an embodiment of the present invention.

FIG. 4 is a view illustrating an outline of an image forming apparatus in an embodiment of the present invention.

Referring to FIG. 4, a photosensitive drum 1, which is an image carrying member for carrying an electrostatic image, is uniformly de-electrified by an exposing unit 2 and is uniformly charged, for example, negatively by a primary charger 3. Thereafter, an electrostatic latent image corresponding to an image signal is formed by receiving an irradiation of laser beams L. This electrostatic latent image is developed into a visible image (toner image) by a developing unit 4. This toner image is transferred by function of a transfer charger 54 onto a transfer material P held on a transfer material carrying belt 53 that is stretched between two pieces of rollers 51, 52 and endlessly driven in an illustrated arrowed direction. Further, residual toners remaining on the photosensitive drum 1 are thereafter scraped off by a cleaner 6.

Further, a developer density controller is provided for compensating a toner density that changed within the developing unit 4 due to the development of the electrostatic latent image. More specifically, the developing unit 4 incorporates a developer density sensor 41 of, e.g., an optical type. The developer density sensor 41 detects a carrier/toner mixture ratio of a 2-component developer D. A detection signal is transmitted to a CPU 94. The CPU 94 calculates a toner replenishing quantity required on the basis of the detection signal to thereby operate a screw driving clutch 75 for a time corresponding thereto. A toner feeding screw 72, serving as a toner feeding member within a toner hopper 7 serving as a toner storage unit, is driven by a motor M via a clutch 75. The toner feeding screw 72 is rotationally driven during a period corresponding exactly to an operating time of the clutch, thereby replenishing an interior of the developing unit 4 with intra-hopper toners T. The toner density within the developing unit 4 is thus kept constant.

Figure 3:
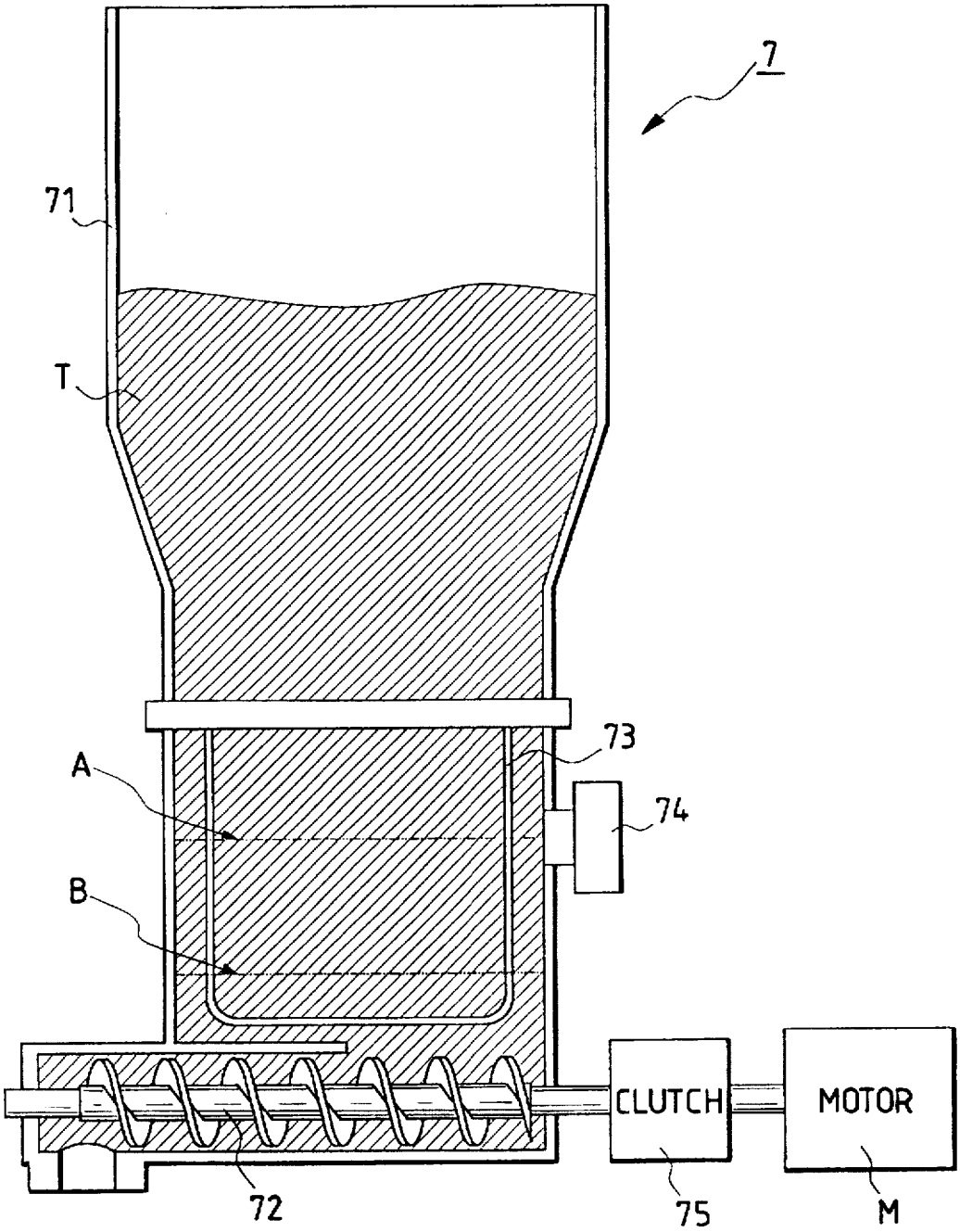
FIG. 3 is a sectional view illustrating a toner hopper.

FIG. 3 is a sectional view illustrating the toner hopper. The toner hopper 7 is constructed of a hopper container 71 for containing the toners T, the above-described toner feeding screw 72 for replenishing the developing unit with the toners, an agitation member 73 for disintegrating and agitating the toners and feeding the toners to a toner feeding screw upstream side, and a toner sensor 74 serving as a toner detecting element for detecting a powder surface of the toners.

A line A is a level of the toner powder surface within the toner hopper when the toner sensor 74 operates (detects). Further, a line B is a level for indicating a limit of whether the toners can be replenished to the developing unit from the hopper without any trouble. When the powder surface level is located below this line B, the toners can not be stably replenished to an upper portion of the screw from a agitation portion (a rotating portion of the agitation member 73). As a result, this leads to such a situation that the density of the developer within the developing unit decreases without replenishing a desired quantity of toners to the developing unit in spite of the fact that the screw is driven.

Accordingly, the hopper must be replenished with the toners before the powder surface reaches the line B.

In accordance with this embodiment, a position (height) of the toner sensor is set so that the toner quantity from the line A (the detection surface level) to the line B (replenishing-possible surface level with respect to the developing unit) becomes approximately 120 g. Then, actually after the toner sensor has detected the powder surface level, the toners of 100 g can be replenished. For realizing this, when the toner sensor functions to detect during continuous copying, there starts to integrate ON time of the driving clutch of the hopper screw. The continuous copying represents a case where the image is formed a plural number of times by one transmission of a start-of-image-formation signal (a copy button, etc.). If a replenishing capability of the hopper screw is 0.5 g/second, it takes 200 seconds to replenish 100 g toners. If the continuous copying comes to an end before the ON-time integrated value (time) of the clutch reaches a predetermined value of 200 seconds an indication of "No Toner" is given to an operating unit (such as a panel, etc.) upon end of copy, thus prompting the user to replenish the hopper with the toners from the toner bottle. If the integrated time reaches 200 seconds prior to end of copy, the continuous copying is temporarily interrupted, and the user is prompted to replenish the hopper with the toners and thereafter restart the copy.

Figure 1:
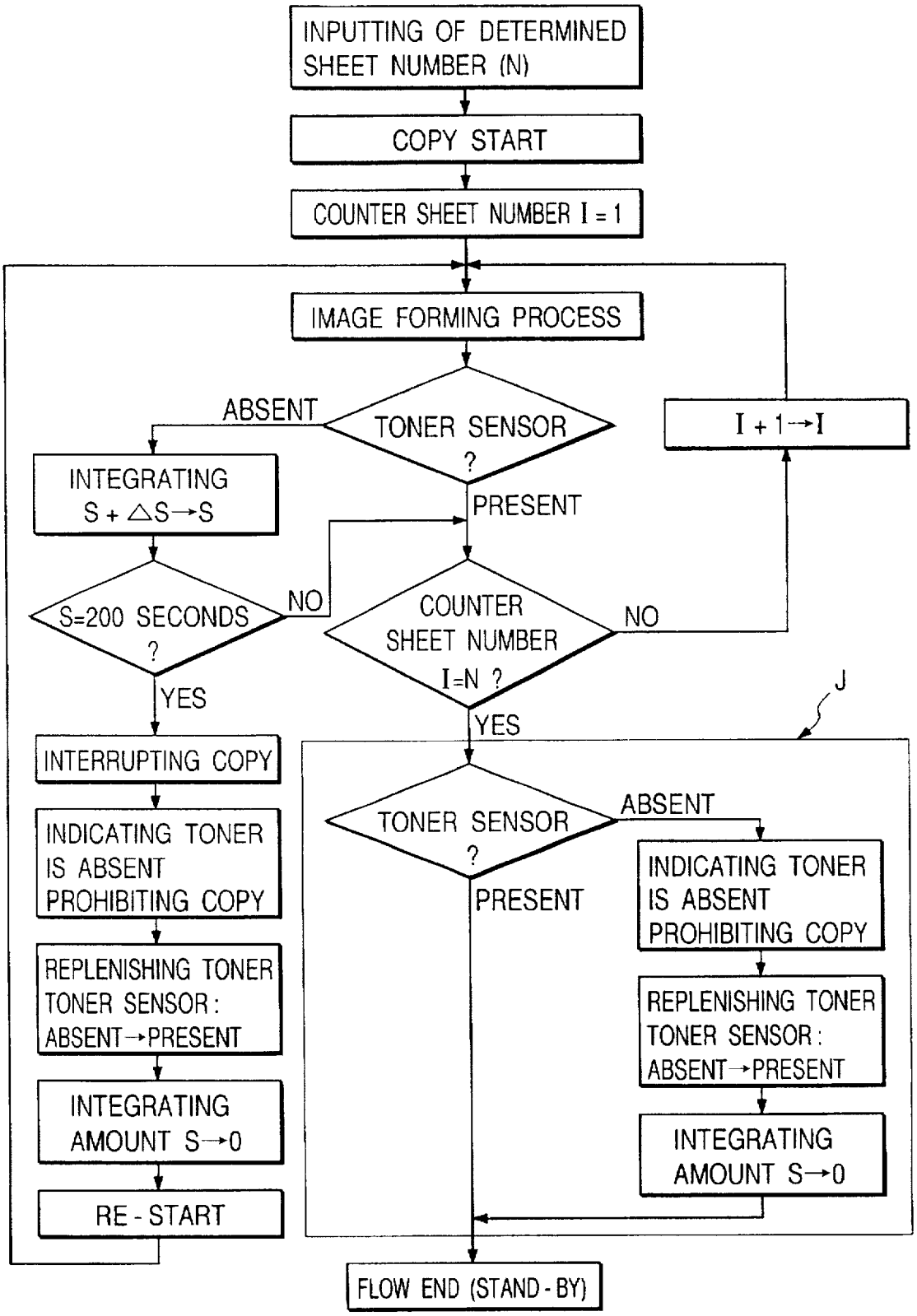
FIG. 1 is a flowchart for explaining a first embodiment of the present invention.

An actual operation of the above-described content will hereinafter be explained with reference to a flowchart of FIG. 1. The user inputs a number of copies (a determined sheet number) N and starts copying by pushing a copy start key. Each time an image is formed on one sheet, the signal of the toner sensor is confirmed. If the toner is present, whether or not a counter sheet number I of the copies reaches the determined sheet number N is checked. If not reached, the counter sheet number I is incremented by 1, then there enters a next image forming process. If the toner sensor detects that toner is absent, the integration of the hopper clutch is started. An integrating amount S (an initial value is 0 sec.) defined as a screw driving time corresponding to the quantity of the toners supplied to the developing unit has an addition of an ON time AS of the clutch thereabout and becomes a new integrating amount. Next, whether or not the integrating amount S reaches 200 seconds is checked.

When the integrating amount reaches 200 seconds, the copying process is interrupted. Then, the indication of "No Toner" is given to the operating unit, and the apparatus is set in a copy inhibited status (an unable restarting status, and a status where a new copy is not accepted). Then, the toner is replenished, whereby the toner sensor signal changes over such as "absent →present". Then, the integrating amount is reset (S is reset to 0 sec.), and the copy inhibited status is released. Subsequently, upon restarting by the user's pushing the start key (copy button), the image forming process starts again.

If the integrating amount S does not reach 200 seconds, whether or not the counter sheet number I reaches the determined sheet number is subsequently checked. If not reached, the image forming process and the integrating process of the integrating amount S are repeated.

As the counter sheet number I reaches the determined sheet number N, the processing proceeds to next step. Herein, the toner sensor signal is again identified. If there exist the toners, a flow of sequential processes are finished, and the apparatus is set in a standby status (a copy acceptable status).

If there is no toner, the indication of "No Toner" is given, and the apparatus is brought into the copy inhibited status.

At that time, as in the above-described case, the sensor signal changes such as "Toner Absent"→"Toner Present" by replenishing the toners. Then, the integrating amount is reset, and the apparatus becomes the standby status, thus finishing the flow of processes.

Note that there is a linear relationship between the clutch ON time (the screw driving time) and the screw replenishing quantity, but a slight scatter might actually exist therein. Taking this into consideration, a margin of 20 g is added to a replenishing possible target of 100 g after detecting the powder surface level, and the toner quantity between the line A and the line B is set to 120 g as above.

As discussed above, the screw driving time after the detection is integrated, and whether or not the copy continuing is determined based on this integrating amount. With this method taken, it is possible to avoid such a situation that an allowable copy sheet number after the detection is uniformly reduced on the assumption of a mode of having a large toner consumption quantity, with the result that the toners within the hopper can be consumed as effectively as possible. As a result, the number of times with which the toners are replenished to the hopper can be decreased. In the case of the continuous copying, it is feasible to reduce a probability at which the consecutive copying operation is interrupted.

(Second Embodiment)

Figure 2:
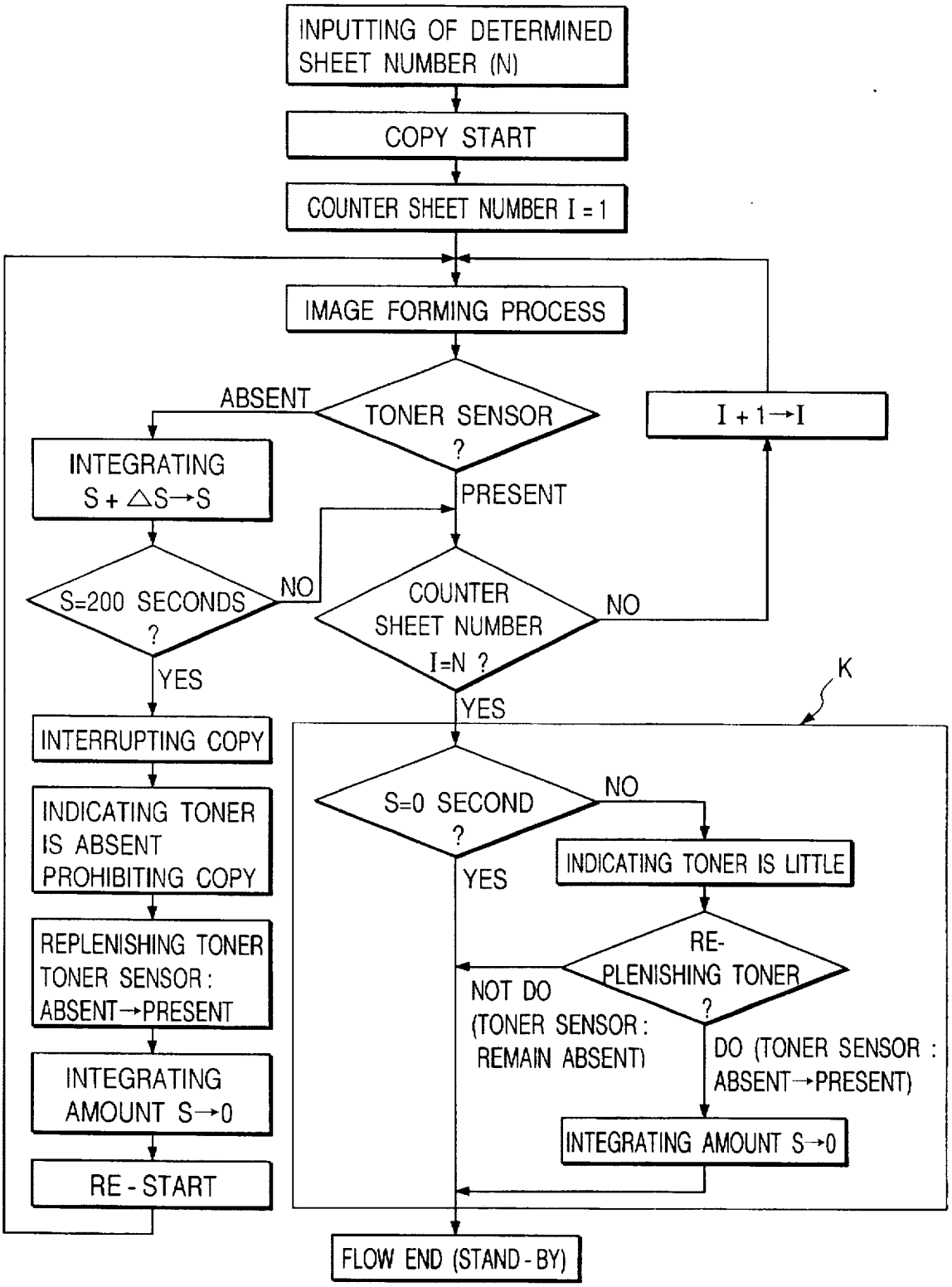
FIG. 2 is a flowchart for explaining a second embodiment of the present invention.

FIG. 2 is a flowchart showing a second embodiment of the present invention.

The apparatus has the same construction as that shown in FIG. 4. A difference from the embodiment discussed above is that the J-portion shown in FIG. 1 is replaced with a K-portion (FIG. 2). In the first embodiment, after the counter sheet number I has reached the determined sheet number N, i.e., after copying has finished, the toner sensor is again confirmed, and, if there is no toner, the copying is inhibited (the status here is the next copy is not accepted). The sensor thereby works during copying (the integration starts), and, if the integrating amount is not 0, the toners are invariably replenished (and the integrating amount is reset) before the flow of processes comes to an end.

In contrast with this, according to this embodiment, the sensor works during copying, and, if the determined sheet number of copies are finished in such a status that the integrating amount S has a relationship of $0 < S < 200$ seconds, the apparatus is set not in the copy inhibited status but in the copy acceptable status (a copy allowable status). The copying operation can be thereby fully performed for the next image formation start signal until the integrating amount S becomes 200 seconds. This eliminates such a drawback that there are still enough toners until the line B shown in FIG. 3 is reached, and nevertheless the copy is inhibited. At the same time, the integrating amount S is not 0, however, there increases the probability of copying being interrupted during copying from the next time onward. Under such circumstances, this embodiment provides a flow of processes that are flexible as will hereinafter be explained. Given hereinbelow is the explanation centered on the K-portion shown in FIG. 2. After the counter sheet number I has come to the determined sheet number N, whether or not the integrating amount is 0, is checked. If the integrating amount is 0 sec., the operation directly finishes, and the apparatus is set in the standby status. If not 0 sec., an indication of "Toner Is Little" is given to the operating unit. This is a piece of information such as "Residual quantity of toners is small. Please replenish toner. If number of copies is small, copying is possible.". The copying is made possible irrespective of whether the toners are replenished or not. There is a case where the user replenishes the toners and a case where the user does not replenish in response to that above information. If replenished (the sensor indication changes such as "Toner Absent"→"Toner Present", the integrating amount S is reset, and the apparatus is set in the standby status. If not replenished, the apparatus is brought into the standby status when the toner sensor detects "Toner Absent". In accordance with this embodiment, when the user is given the indication of "Toner Is Little", the copy can be performed without replenishing the toners in the case of, e.g., copying a small number of sheets quickly. For instance, when temporarily separating from the apparatus because of a large number of sheets, the copying might start after replenishing the toners to avoid the interruption. Thus, the user has a latitude of choice, and it is possible to provide the apparatus flexible enough to correspond to the user's circumstances.

As discussed above, the first embodiment exhibits a pure effect for such a purpose as to reduce the probability of interrupting each copy or continuous copying. Further, the second embodiment has such an effect that the apparatus is capable of showing the flexible correspondence to the desires of the user. More specifically, the operation in the second embodiment is not that the copy is all inhibited due to the indication of "Toner Absent" but that a warning of "Toner Is Little" is given, and the copy is allowed to perform. Therefore, for example, if no toner bottle is prepared, the effect is that the user is given a flexible correspondence such as providing enough time to prepare.

(Third Embodiment)

Figure 5:
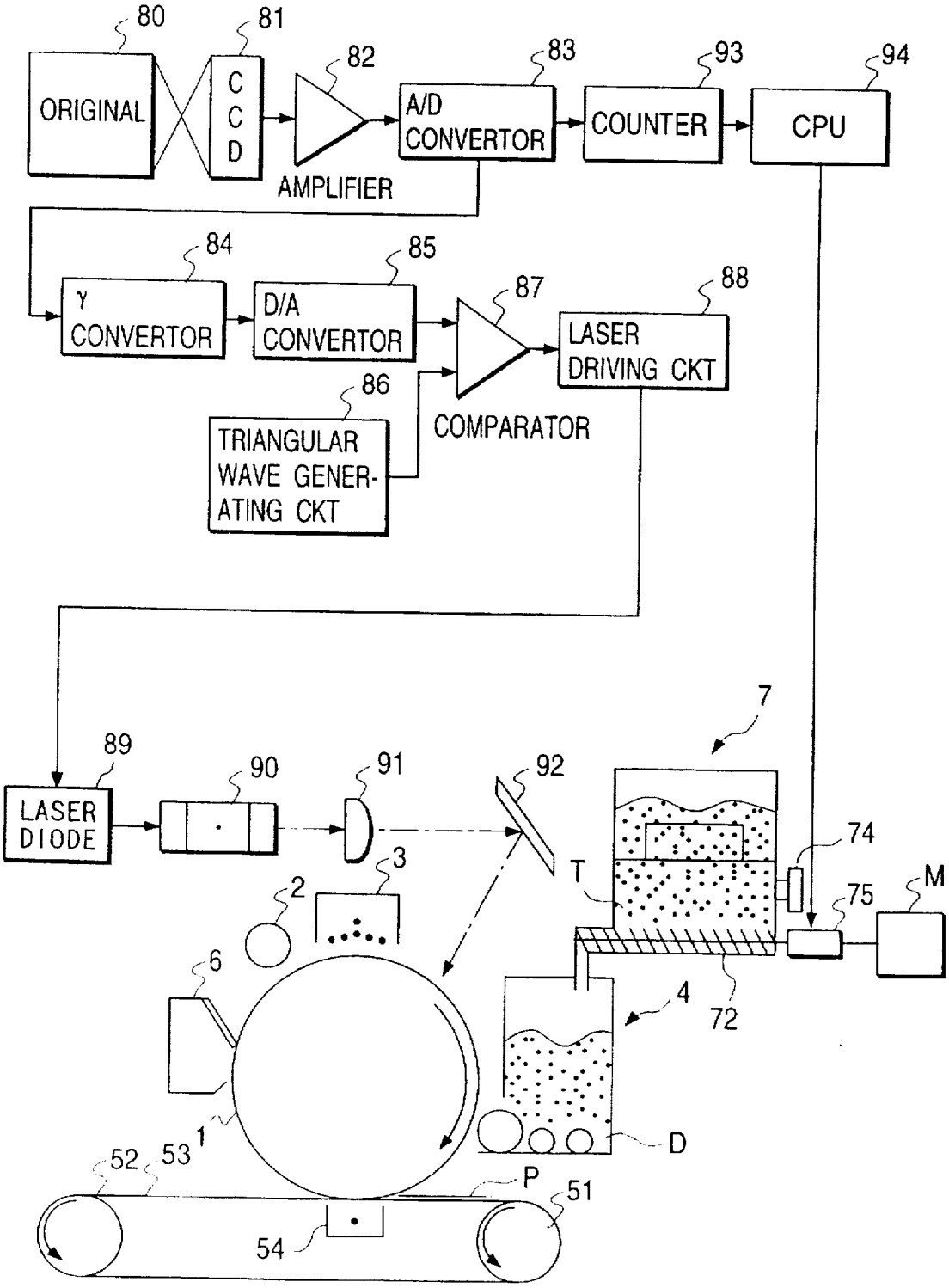
FIG. 5 is a view illustrating an outline of the image forming apparatus in the embodiment of the present invention.

FIG. 5 is a view illustrating an outline of the image forming apparatus in a third embodiment of the present invention.

Referring to FIG. 5, to start with, a CCD 81 reads an image of an original 80. An obtained analog image signal is amplified up to a predetermined level by an amplifier 82 and then converted into, e.g., an 8-bit (0–255 gradations) digital image signal by analog-to-digital (A/D) converter. Next, this digital image signal is supplied to a γ converter 84 (which consists of a 256-byte RAM in this embodiment and is a converter for performing a density conversion in a look-up table system), wherein the same signal is γ-compensated. The γ-compensated signal is then inputted to a digital-to-analog (D/A) converter 85. The digital image signal is converted into an analog image signal again and then inputted to one input of a comparators 87. Supplied to an other input of the comparator 87 is a triangular wave signal having a predetermined frequency that is generated by a triangular wave generating circuit 86. The analog image signal supplied to the input of one comparator 87 is compared with the triangular wave signal and then pulse-width-modulated. This binary image signal pulse-width-modulated is inputted directly to a laser drive circuit 88 and is used as an ON/OFF control signal for an emission of light of a laser diode 89. Laser beams emitted from the laser diode 89 are scanned by a known polygon mirror 90 in a main scan direction. The laser beams then are irradiated onto a photosensitive drum 1 serving as an image carrying member rotating in an arrowed direction via an f/θ lens 91 and a reflecting mirror 92, thereby forming an electrostatic latent image.

A developer density controller of a video count system is provided for compensating a toner density varied within the developing unit 4 due to the development of the latent image, wherein an output level of the digital image signal per pixel is integrated, and a quantity of the consumed toners is estimatingly replenished. That is, the output level of the image signal converted into the digital signal by the A/D converter 83 is integrated per pixel. The thus integrated output level is converted into a video count number by a video counter 93 and then transmitted to a CPU 94. The CPU 94 converts the video count number into a replenishing quantity and operates a drive clutch 75 of the hopper screw for a time corresponding thereto. A proper quantity of toners are replenished to the developing unit 4 from the toner hopper 7, thus keeping the toner density within the developing unit 4. As explained above, the video count value is a value corresponding to the quantity of toners supplied to the developing unit.

In accordance with the third embodiment also, the toner hopper shown in FIG. 3 is used as in the first and second embodiments.

When the video count number since the toner sensor detected "Toner Absent" reaches a predetermined value, there are performed the interruption and inhibition of the copying and the indication of "Toner Absent".

Note that the operations are the same as those in the first or second embodiment except for using the video count number as an integrating amount.

As described above, when replenishing the toners having the quantity calculated based on the video count number, there is no necessity for providing a special counter by making use of the video count number as a quantity integrated after the toner sensor has detected the deficiency of toners, and hence the number of components is not required to increase.

Further, the replenishing screw is driven based on the video count number, and, therefore, the copying is interrupted after integrating the voice count number. The apparatus can be thereby corresponds to a hopper capacity with a higher accuracy.

Although the embodiments of the present invention have been described so far, the present invention is not limited to those embodiments but may be modified in many forms within the technical concept.

What is claimed is:

1. An image forming apparatus comprising:

an image carrying member for carrying an image;

a developing unit for developing an electrostatic image on said image carrying member by a toner;

a toner storage unit for storing the toner as a supply of the toner to said developing unit;

a supplying unit for supplying the toner from said toner storage unit to said developing unit:

residual quantity detecting means for detecting a residual quantity of the toner within said toner storage unit;

integrating means for integrating a supplying quantity by said supplying unit, said integrating means starting integrating after detecting a lack of the toner by said residual quantity detecting means; and inhibiting means for stopping and inhibiting an image forming operation when an integrated value of said integrating means reaches a predetermined value in a situation where said residual quantity detecting means detects the lack of the toner during a continuous image forming operation.

2. The image forming apparatus according to claim 1, wherein said supplying unit has feeding means for feeding the toners within said toner storage unit to replenish the toners to said developing unit, and said integrating means integrates a driving time of said feeding means.

3. The image forming apparatus according to claim 1, wherein when a series of image forming processes finish before the integrated value reaches the predetermined value after said residual quantity detecting means has detected the lack of the toner residual quantity, said inhibiting means inhibits the image forming operation just when the last of the series of image forming processes is completed.

4. The image forming apparatus according to claim 1, wherein said inhibiting means inhibits the image forming operation until said toner storage unit is replenished with the toners, and said residual quantity detecting means detects that there is a sufficient quantity of toner to allow the image forming operation to continue.

5. The image forming apparatus according to claim 1, further comprising:

indicating means for indicating absence of the toners, said indicating means indicating the absence of the toner upon stopping of the image forming operation after said residual quantity detecting means has detected the lack of the toner residual quantity.

6. The image forming apparatus according to claim 5, wherein there must be released the indication of the absence of the toner by said indicating means and the inhibition of the image forming operation by said inhibiting means when said residual quantity detecting means detects that the toner is replenished.

7. An image forming apparatus comprising:

an image carrying member;

an electrostatic image forming means for forming an electrostatic image on said image carrying member on the basis of an image signal;

a developing unit for developing an electrostatic image;

a toner storing unit for storing the toner as a supply of the toner to said developing unit;

residual quantity detecting means for detecting a residual quantity of the toner within said toner storage unit;

integrating means for integrating a number of image signals, said integrating means start the integrating after detection of lack of the toner by said residual quantity detecting means; and inhibiting means for stopping and inhibiting an image forming operation when an integrated value of said integrating means reaches a predetermined value in case where said residual quantity detecting means detects the lack of the toner during continuous image forming operation.

8. The image forming apparatus according to claim 7, wherein said apparatus further comprising a supplying unit for supplying the toner of a quantity corresponding to the number of image signals from said toner storage unit to said developing unit.

9. The image forming apparatus according to claim 7, wherein when a series of image forming processes finish before the integrated value reaches the predetermined value after said residual quantity detecting means has detected the lack of the toner residual quantity, said inhibiting means inhibits the image forming operation just when the image formation comes to an end.

10. The image forming apparatus according to claim 7, wherein said inhibiting means inhibits the image forming operation until said toner storage unit is replenished with the toner, and said residual quantity detecting means detects that there is a sufficient quantity of toner to allow the image forming operation to continue.

11. The image forming apparatus according to claim 7, further comprising:

indicating means for indicating an absence of the toner, said indicating means indicating the absence of the toner upon stopping of the image forming operation after said residual quantity detecting means has detected the lack of the toner residual quantity.

12. The image forming apparatus according to claim 7, wherein there must be released the indication of the absence of the toner by said indicating means and the inhibition of the image forming operation by said inhibiting means when said residual quantity detecting means detects that the toner is replenished.

* * * * *

UNITED STATES PATENT AND TRADEMARK OFFICE

CERTIFICATE OF CORRECTION

PATENT NO. : 5,754,916

DATED : May 19, 1998

INVENTOR(S) : KITAYAMA ET AL.

It is certified that error appears in the above-indentified patent and that said Letters Patent is hereby corrected as shown below:

Title page, item [73] Assignee

"Canon Kabushiki Kaisha, Japan" should read --Canon Kabushiki Kaisha, Tokyo, Japan--.

Column 2

Line 8, "a image" should read --an image--.

Column 3

Line 60, "a" should read --an--.

Column 4

Line 17, "seconds." should read --seconds,--.
Line 46, "an unable" should read --a disable--.
Line 61, "next" should read --the next--.

Column 5

Line 44, "are" should read --is--.
Line 57, "are" should read --is--.
Line 67, "possible.". should read --possible--.

UNITED STATES PATENT AND TRADEMARK OFFICE

CERTIFICATE OF CORRECTION

PATENT NO. : 5,754,916

DATED : May 19, 1998

INVENTOR(S) : KITAYAMA ET AL.

It is certified that error appears in the above-indentified patent and that said Letters Patent is hereby corrected as shown below:

Column 6

Line 48, "comparators" should read --comparator--; and "an" should read --an- --.

Signed and Sealed this

Ninth Day of February, 1999

*Attest:*

*Attesting Officer*

*Acting Commissioner of Patents and Trademarks*